US006550808B1

(12) United States Patent
Mendenhall

(10) Patent No.: US 6,550,808 B1
(45) Date of Patent: Apr. 22, 2003

(54) GUANYLUREA NITRATE IN GAS GENERATION

(75) Inventor: Ivan V. Mendenhall, Providence, UT (US)

(73) Assignee: Autoliv ASP. Inc., Ogden, UT (US)

( * ) Notice: Subject to any disclaimer, the term of this patent is extended or adjusted under 35 U.S.C. 154(b) by 65 days.

(21) Appl. No.: 09/715,459

(22) Filed: Nov. 17, 2000

(51) Int. Cl.[7] ..... B60R 21/28; C06B 31/00; C06B 31/32

(52) U.S. Cl. ..... 280/741; 102/530; 149/45; 149/47; 149/92

(58) Field of Search ..... 149/45, 47, 36, 149/92; 280/741; 102/530

(56) References Cited

U.S. PATENT DOCUMENTS 4,559,409 A * 12/1985 Seyerl ..... 564/32
5,608,183 A * 3/1997 Barnes et al. ..... 149/36
5,661,261 A * 8/1997 Ramaswamy et al. ..... 149/20
5,889,161 A * 3/1999 Bottaro et al. ..... 149/109.6
5,989,367 A * 11/1999 Zeuner et al. ..... 149/36
6,024,812 A 2/2000 Bley et al.
6,074,502 A * 6/2000 Burns et al. ..... 149/36
6,077,372 A * 6/2000 Mendenhall et al. .... 149/109.6
6,117,255 A * 9/2000 Blomquist ..... 149/36
6,132,538 A 10/2000 Mendenhall et al.
6,156,137 A * 12/2000 Lundstrom et al. ..... 149/19.1
6,255,512 B1 * 7/2001 Bottaro et al. ..... 149/92

FOREIGN PATENT DOCUMENTS

EP 519 485 6/1992

OTHER PUBLICATIONS

Basil T. Fedoroff et al.: *Encyclopedia of Explosives and Related Items*, A210–A213, vol. 1, Picatinny Arsenal, Dover, New Jersey, 1960.

* cited by examiner

*Primary Examiner*—Edward A. Miller
(74) *Attorney, Agent, or Firm*—Sally J. Brown; James D. Erickson

(57) ABSTRACT

Gas generant compositions are provided which compositions react to produce nitrogen gas and which compositions include guanylurea nitrate and at least one transition metal-containing water-compatible oxidizer. Also, related methods of gas generation are provided.

26 Claims, 1 Drawing Sheet

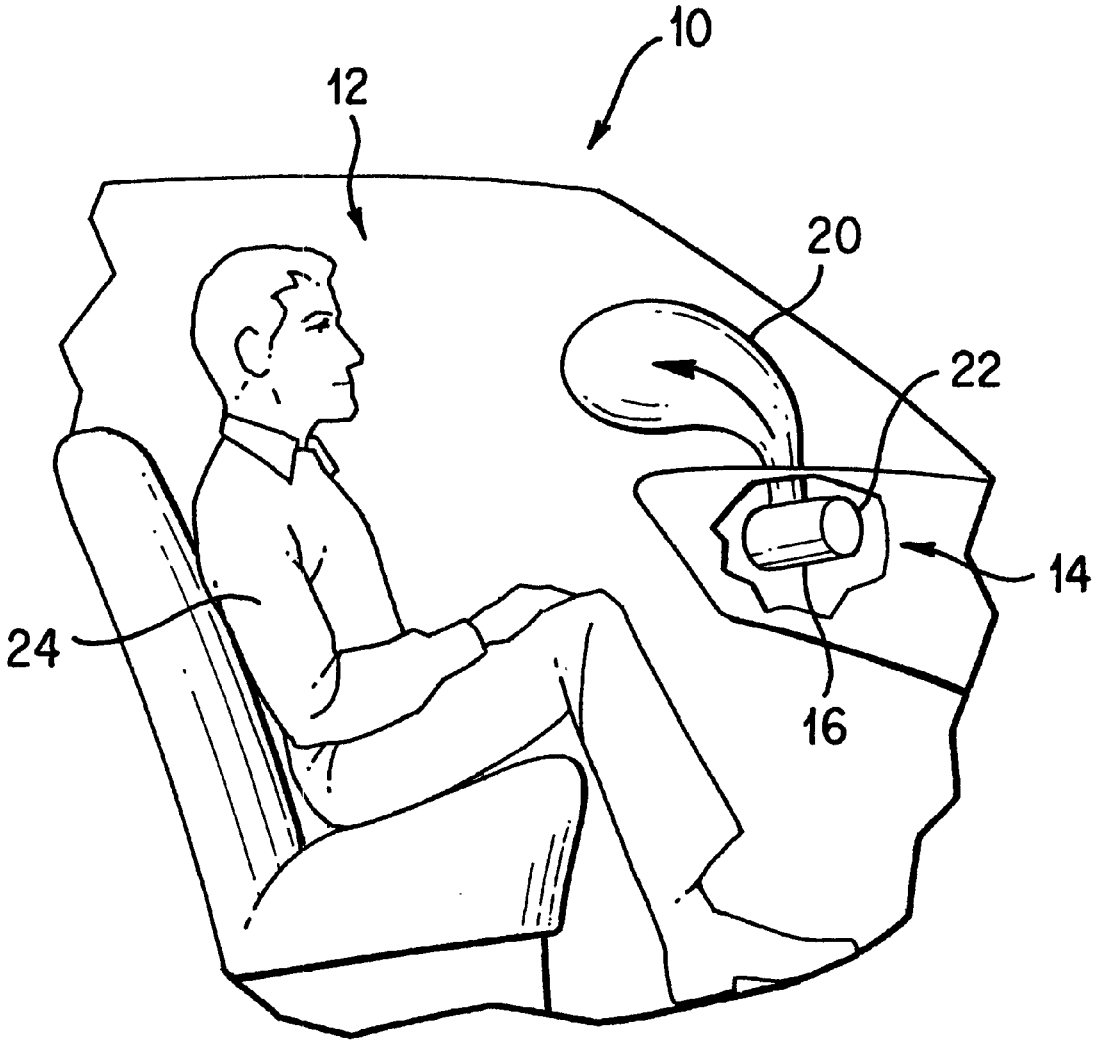
10
12
20
22
14
24
16

GUANYLUREA NITRATE IN GAS GENERATION

BACKGROUND OF THE INVENTION

This invention relates generally to gas generant materials such as used to inflate automotive inflatable restraint airbag cushions and, more particularly, to gas generant materials which contain guanylurea nitrate and the use of such gas generant materials.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon system actuation, the cushion begins to be inflated in a matter of no more than a few milliseconds with gas produced or supplied by a device commonly referred to as an "inflator."

Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as relating to the safe and effective handling, supply and disposal of such gas generant materials.

In view thereof, significant efforts have been directed to minimizing or avoiding the use of sodium azide in automotive airbag inflators. Through such efforts, various combinations of non-azide fuels and oxidizers have been proposed for use in gas generant compositions. These non-azide fuels are generally desirably less toxic to make and use, as compared to sodium azide, and may therefore be easier to dispose of and thus, at least in part, found more acceptable by the general public. Further, non-azide fuels composed of carbon, hydrogen, nitrogen and oxygen atoms typically yield all gaseous products upon combustion. As will be appreciated by those skilled in the art, fuels with high nitrogen and hydrogen contents and a low carbon content are generally attractive for use in such inflatable restraint applications due to their relatively high gas outputs (such as measured in terms of moles of gas produced per 100 grams of gas generant material).

In addition to low toxicity and high gas outputs, fuel components for use in gas generant materials desirably are relatively inexpensive, thermally stable (i.e., desirably decompose only at temperatures greater than about 160° C.), and have a low affinity for moisture.

Oxidizers known in the art and commonly employed in such gas generant compositions include transition metal-containing water-compatible oxidizers such as transition metal oxides, transition metal peroxides and transition metal-containing salts of oxygen-bearing anions, such as including basic nitrates, for example. Unfortunately, transition metal-containing oxidizers may undesirably react with other composition materials to form metallic derivatives of a highly explosive nature and which are not generally suited for use in an automotive inflatable restraint system or a gas generating device used in such a safety system. Thus, when including transition metal-containing water-compatible oxidizers in such formulations care is required to ensure that the formulation does not also include a material which may undesirably react therewith to form such explosive metallic derivatives.

U.S. Pat. No. 6,024,812 discloses propellant formulations which include nitroaminoguanidine as a main component, a secondary fuel or explosive ingredient such as dicyandiamidine nitrate (also known as "guanylurea nitrate") and an oxidizing agent. This patent discloses that oxidizing agents useful in the propellant formulation thereof include nitrates of alkali and alkaline earth elements, perchlorates of alkali and alkaline earth elements, ammonium nitrate, ammonium perchlorate or mixtures of these compounds.

Those skilled in the art will appreciate that nitroaminoguanidine exists in a form which has acid characteristics and can form metallic derivatives of a highly explosive nature. Thus, oxidizers which contain a transition metal are incompatible with nitroaminoguanidine in known automotive inflatable restraint system gas generation applications.

In typical gas generant compositions, the capability for the composition, including the oxidizer, to be processed via water-based processing has various practical and commercial benefits. For example, through the use of water-based processing, the components of the compositions can be mixed or otherwise processed with more uniformity such as to desirably result in less compositional variability. Further, as compared to dry mixing of compositional components, water-based processing can produce or result in improved material handling safety. Unfortunately, typical peroxide forms of gas generant oxidizers undergo decomposition when put in contact with water. As a result, gas generant compositions which include peroxide forms of oxidizers are typically processed via dry blending and thus, the advantages of water-based processing cannot be realizable therewith.

Further, those skilled in the art will also appreciate that upon combustion the metallic component of transition metal-containing oxidizers typically ends up as a solid. Thus, the amount of oxidizer included in such gas generant materials can significantly effect the amount of gas resulting upon combustion of the gas generant material. In view thereof, efforts have been directed to reducing or minimizing the amount of oxidizer required in such gas generant formulations. One approach used with at least some success in reducing or minimizing the required amount of oxidizer involves the incorporation of oxygen, in greater relative amounts, in the fuel component of the gas generant composition. Thus, desirable fuels for use in such gas generant compositions may preferably include a relatively high content of oxygen.

In addition to the above-identified desirable properties and characteristics, gas generant materials for use in automotive inflatable restraint applications must be sufficiently reactive such that upon the proper initiation of the reaction thereof, the resulting gas producing or generating reaction occurs sufficiently rapidly such that a corresponding inflatable airbag cushion is properly inflated so as to provide desired impact protection to an associated vehicle occupant. In general, the burn rate for a gas generant composition can be represented by the equation (1), below:

$$Rb=Bp^{n} \quad (1)$$

where,

Rb=burn rate (linear)

B=constant

P=pressure n=pressure exponent, where the pressure exponent is the slope of the plot of the log of pressure along the x-axis versus the log of the burn rate along the y-axis Guanidine nitrate ($CH_6N_4O_3$) is a non-azide fuel with many of the above-identified desirable fuel properties and which has been widely utilized in the automotive airbag industry. For example, guanidine nitrate is commercially available, relatively low cost, non-toxic, provides excellent gas output due to a high content of nitrogen, hydrogen and oxygen and a low carbon content and has sufficient thermal stability to permit spray dry processing.

Unfortunately, guanidine nitrate suffers from a lower than may be desired burn rate. Thus, there remains a need and a demand for an azide-free gas generant material which may more effectively overcome one or more of the problems or shortcomings described above. In particular, there is a need and a demand for gas generant materials which, while effective in overcoming one or more of the problems or shortcomings identified above, also provides or results in a desirably rapid burn rate as required or desired for particular applications while incorporating or using a transition metal-containing water-compatible oxidizer.

SUMMARY OF THE INVENTION

A general object of the invention is to provide improved gas generation and, more particularly, to provide improved gas generant compositions and associated gas generant composition-containing devices and methods of gas generation.

A more specific objective of the invention is to overcome one or more of the problems described above.

The general object of the invention can be attained, at least in part, through a gas generating composition which includes or contains guanylurea nitrate and at least one transition metal-containing water-compatible oxidizer present in sufficient relative amount such that, upon combustion reaction initiation of the at least one transition metal-containing water-compatible oxidizer with the guanylurea nitrate, reaction products including a quantity of nitrogen gas are produced.

The prior art generally fails to provide gas generant materials which, while avoiding inclusion or reliance on azide or azide-based materials, also suitably satisfies selected criteria such as relating to manufacture and performance. In particular, the gas generant materials of the prior art and such as used in gas generating devices used in automotive inflatable restraint systems, for example, generally fail to provide or result in desirably high burn rates while also satisfying, as effectively as desired, criteria relating to manufacture or performance such as, for example, including:

a) avoidance of inclusion or reliance on azide or azide-based materials;

b) cost;

c) safety;

d) gas output;

e) thermal stability;

f) effluent toxicity; and g) ease of manufacture or production via water-based processing.

The invention further comprehends a method of generating gas involving reacting a gas generant composition which contains guanylurea nitrate and at least one transition metal-containing water-compatible oxidizer present in sufficient relative amount such that, upon combustion reaction initiation of the at least one transition metal-containing water-compatible oxidizer with the guanylurea nitrate, reaction products including a quantity of nitrogen gas are produced.

Also, provided is an improved method of synthesizing guanylurea nitrate wherein dicyandiamide is reacted with nitric acid.

As used herein, references to a specific composition, component or material as a "fuel" are to be understood to refer to a chemical which generally lacks sufficient oxygen to burn completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

Further, references herein to "water-compatible" oxidizers are to be understood to refer to oxidizers which are generally stable in water and such as will not generally react with water, at normal processing and handling conditions, to form byproducts.

Other objects and advantages will be apparent to those skilled in the art from the following detailed description taken in conjunction with the appended claims and drawings.

BRIEF DESCRIPTION OF THE DRAWINGS

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

The present invention provides gas generant materials such as may be used in the inflation of inflatable devices such as vehicle occupant restraint airbag cushions. Such gas generant materials typically include guanylurea nitrate ($NH_2C(NH)NHC(O)NH_2 \cdot HNO_3$) and at least one transition metal-containing water-compatible oxidizer present in sufficient relative amount such that, upon combustion reaction initiation of the at least one transition metal-containing water-compatible oxidizer with the guanylurea nitrate, reaction products including a quantity of nitrogen gas are produced.

In such gas generant compositions, guanylurea nitrate (also known as dicyandiamidine and amidinourea) primarily serves as a fuel material. In particular, guanylurea nitrate has been found to advantageously have a relatively high theoretical density such as permits a relatively high loading density for a gas generant material which contains such a fuel component. Further, guanylurea nitrate exhibits excellent thermal stability, as evidenced by guanylurea nitrate having a thermal decomposition temperature of 216° C. In addition, guanylurea nitrate has a large negative heat of formation (i.e., −880 cal/gram) such as results in a cooler burning gas generant composition, as compared to an otherwise similar gas generant containing guanidine nitrate.

In accordance with a preferred practice of the invention, through the inclusion or use of guanylurea nitrate in gas generant materials, reliance on the inclusion or use of sodium azide or other similar azide materials can be avoided while providing desirably sufficiently high or improved burn rates and overcoming one or more of the problems, shortcomings or limitations such as relating to cost, commercial availability, low toxicity, thermally stability and low affinity for moisture.

In practice, preferred gas generant compositions in accordance with the invention contain or include fuel component in the range of about 20 to about 70 composition weight percent. Gas generant compositions in accordance with the invention may additionally contain or include one or more additional non-azide fuel material. For example, in accordance with certain preferred embodiments of the invention, gas generant compositions contain or include guanidine nitrate in addition to guanylurea nitrate. Thus, in the general practice of the invention between about 10 up to 100 percent of the fuel material component is guanylurea nitrate. Those skilled in the art and guided by the teachings herein provided will be able to determine the appropriate relative amount of guanylurea nitrate for inclusion in particular gas generant compositions dependent on factors such as desired relative burn rate and gas output. In particular, through the inclusion of a greater relative amount of guanylurea nitrate, compositions exhibiting higher relative bum rates may be realized. On the other hand, gas generant compositions having increased contents of guanylurea nitrate may, however, exhibit at least somewhat reduced gas outputs.

As identified above, gas generant compositions in accordance with certain preferred embodiments of the invention contain or include at least one transition metal-containing water-compatible oxidizer present in sufficient relative amount such that, upon combustion reaction initiation of the at least one transition metal-containing water-compatible oxidizer with the guanylurea nitrate, reaction products including a quantity of nitrogen gas are produced. In accordance with certain preferred embodiments of the invention, about 30 to about 80 weight percent of the subject gas generant compositions generally constitutes such oxidizer component.

As will be appreciated by those skilled in the art and guided by the teachings herein provided, various such oxidizer materials such as known in the art can be used in the practice of the invention. For example and without unnecessary limitation of the broader practice of the invention, useful transition metal-containing water-compatible oxidizers for use in the practice of the invention may include basic metal nitrates, such as basic copper nitrate and basic zinc nitrate, for example, and metal ammine nitrates, such copper diammine dinitrate and zinc diammine dinitrate, for example. In addition, gas generant compositions in accordance with certain preferred embodiments of the invention may contain ammonium nitrate and include one or more metal ammine nitrates in an amount sufficient to phase-stabilize the quantity of ammonium nitrate, such as disclosed in prior U.S. patent application Ser. No. 09/124,944, filed on Jul. 30, 1998 now U.S. Pat. No. 6,132,538, and whose disclosure is hereby incorporated by reference herein and made a part hereof, including but not limited to those portions which specifically appear hereinafter. Yet still further, gas generant compositions in accordance with the invention may include a combination or mixture of two or more of such transition metal-containing oxidizers, either from the same or different of such groups. For example, specific gas generant compositions in accordance with the invention may include a combination of two or more basic metal nitrates, two or more metal ammine nitrates, a basic metal nitrate and a metal ammine nitrate, and a combination of a metal ammine nitrate oxidizer and ammonium nitrate phase stabilized via the inclusion of a metal ammine nitrate phase stabilizer, wherein the metal ammine nitrate oxidizer and metal ammine nitrate phase stabilizer can appropriately be of a same or different chemical formulation.

Those skilled in the art and guided by the teachings herein provided will appreciate that transition metal peroxides, such as zinc peroxide, are generally unsuited for use in the practice of the invention. In particular, a material such as zinc peroxide typically exhibits sufficient reactivity with water such as to render such materials unsuited for water-based processing, as described above.

Gas generant compositions in accordance with the invention may also desirably contain one or more additives such as known in the art. Such additives typically function to satisfy one or more of the following conditions: increase the burn rate of the gas generant composition; improve the handling or other material characteristics of the slag which remains after combustion or reaction of the gas generant material; serve to cool the products formed upon reaction and improve either or both the ability to handle or process the gas generant material. For example, gas generant compositions in accordance with the invention may contain or include one or more additives such as silica and alumina, in a relative amount of between about 0 to about 10 weight percent, preferably in an amount of about 2 to about 5 weight percent, where such weight percentages are on the basis of the total gas generant material composition.

Gas generating compositions in accordance with a preferred embodiment of the invention are free of nitroaminoguanidine such as to avoid undesired reaction by or with the transition metal-containing water-compatible oxidizer present in the compositions. In particular, reaction by or between nitroaminoguanidine and the transition metal-containing water-compatible oxidizer or the reaction products formed thereby such as to form metallic derivatives of a highly explosive nature is desirably avoided.

In accordance with a preferred embodiment of the invention, guanylurea nitrate can be synthesized by reacting dicyandiamide with nitric acid in stoichiometric amounts in a heated (e.g., about 60° C.) aqueous slurry. As dicyandiamide and nitric acid are relatively inexpensive and such synthesis is relatively straightforward, guanylurea nitrate can at least be cost competitive with guanidine nitrate.

As will be appreciated, gas generating compositions in accordance with the invention can be incorporated, utilized or practiced in conjunction with a variety of different structures, assemblies and systems. As representative, the FIGURE illustrates a vehicle 10 having an interior 12 wherein is positioned an inflatable vehicle occupant safety restraint system, generally designated by the reference numeral 14. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an inflator.

The inflator 22 contains a quantity of a gas generant composition in accordance with the invention and such as described above. The inflator 22 also includes an ignitor, such as known in the art, for initiating combustion of the gas generating composition in ignition communication with the gas generant composition. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

TABLE 1

| INGREDIENT | COMP. EXAMPLE 1 | EXAMPLE 1 | COMP. EXAMPLE 2 | EXAMPLE 2 |
|---|---|---|---|---|
| Guanidine nitrate | 43.88 | — | 51.74 | — |
| Guanylurea nitrate | — | 37.80 | — | 45.46 |
| $SiO_2$ | 3.00 | 3.00 | 3.00 | 3.00 |
| Basic copper nitrate | — | — | 45.26 | 51.54 |
| Copper diammine dinitrate | 53.12 | 59.20 | — | — |

TABLE 2

| CHARACTERISTIC | COMP. EXAMPLE 1 | EXAMPLE 1 | COMP. EXAMPLE 2 | EXAMPLE 2 |
|---|---|---|---|---|
| Gas yield (moles/100 g) | 3.36 | 3.17 | 2.92 | 2.63 |
| Density | 1.78 | 1.93 | 1.95 | 2.20 |
| Gas yield (moles/cc) | 0.0598 | 0.0612 | 0.0569 | 0.0579 |
| Flame Temp. $T_c$ (K) | 2258 | 2171 | 1879 | 1666 |
| HEX (cal/g) | 891.25 | 811 | 670.32 | 540.00 |
| BURN RATE | | | | |
| -Rb @ 1000 psi (inch/sec) | 0.25 | 0.33 | 0.32 | 0.51 |
| -slope | 0.501 | 0.463 | 0.439 | 0.413 |
| -constant | 0.008 | 0.013 | 0.016 | 0.030 |
| SENSITIVITY | | | | |
| -impact (inches) | 30 | 30 | 30 | 30 |
| -friction (Newtons) | >360 | >360 | >360 | >360 |
| -EDS (Joules) | >11.25 | >11.25 | >11.25 | >11.25 |
| autoignition temp. (° C.) | 180 | 160 | 180 | 177 |

EXAMPLES

Examples 1–2 and Comparative Examples 1–2

In each of these tests, gas generant material powders having the specific compositions shown in TABLE 1 were prepared, where numerical values refer to weight percentages. Samples of each of the specific compositions were subjected to sensitivity testing with the results of such sensitivity testing shown in TABLE 2, below. Samples of each of the specific compositions were press-formed at 12,000 lbs. of force into slugs having a solid cylindrical shape 0.5 inch in diameter. These gas generant material slugs were then each evaluated for burn rate, as well as burn rate slope and constant. The results of such evaluation are shown in TABLE 2, below. TABLE 2 also includes thermochemical data (e.g., gas yield in moles per 100 grams of generant, flame temperature ($T_c$) in Kelvin, and HEX in calories per gram) which was calculated in each case using the commercially available software program "PEP 1" (Propulsion Evaluation Program), compiled by Martin Marietta.

Discussion of Results

As the data in TABLE 2 shows, the gas generant inclusion and use of guanylurea nitrate instead of guanidine nitrate resulted in formulations having increased burn rates. Additionally, the formulation inclusion and use of guanylurea nitrate instead of guanidine nitrate resulted in formulations having the additional benefit of reduced flame temperature. As a result, such formulations would be expected to result in improved effluents, e.g., an effluent with a reduced $NO_x$ content. Further, as a result of the higher density of guanylurea nitrate, as compared to guanidine nitrate, the guanylurea nitrate-containing compositions were found to supply a higher volumetric gas output.

The reduced burn rate slopes realized with the compositions in accordance with the invention indicate that such compositions are less sensitive to pressure and, as a result, the inclusion and use of such compositions can desirably produce or result in less variability in inflator performance. Also, the sensitivity data shows that the compositions of the invention do not produce or result in an undesirable increase is performance sensitivity. Thus, such compositions are conducive to incorporation and use in inflation devices without requiring special or unusual manufacturing or operating procedures.

Thus, the invention provides a gas generating composition such as used in gas generating devices such as used in automotive inflatable restraint systems, which gas generant materials, while avoiding including or avoiding reliance on azide or azide-based materials, satisfies manufacturing and performance criteria such as relating to cost, safety, gas output, thermal stability, effluent toxicity and ease of manufacture or production via water-based processing, for example, in an effective manner while also providing or resulting in desirably high burn rates.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generating composition comprising:

guanylurea nitrate and at least one transition metal-containing water-compatible oxidizer present in sufficient relative amount such that, upon combustion reaction initiation of the at least one transition metal-containing water-compatible oxidizer with the guanylurea nitrate, reaction products including a quantity of nitrogen gas are produced, and wherein said gas generating composition has a flame temperature of less than 2200 K.

2. The gas generating composition of claim 1 wherein said gas generating composition is free of nitroaminoguanidine.

3. The gas generating composition of claim 1 comprising at least one basic metal nitrate as the at least one transition metal-containing water-compatible oxidizer.

4. The gas generating composition of claim 3 wherein the at least one basic metal nitrate is basic copper nitrate.

5. The gas generating composition of claim 1 comprising at least one metal ammine nitrate as the at least one transition metal-containing water-compatible oxidizer.

6. The gas generating composition of claim 5 wherein the at least one metal ammine nitrate is copper diammine dinitrate.

7. The gas generating composition of claim 5 additionally comprising a quantity of ammonium nitrate.

8. The gas generating composition of claim 7 comprising a total metal ammine nitrate content in an amount sufficient to phase-stabilize the quantity of ammonium nitrate.

9. The gas generating composition of claim 1 having a fuel component in a relative amount of between about 20 to about 70 composition weight percent and an oxidizer component in a relative amount of between about 30 to about 80 composition weight percent.

10. The gas generating composition of claim 1 additionally comprising at least one additional non-azide fuel material.

11. The gas generating composition of claim 10 having a fuel component of which between about 10 to 100 percent is guanylurea nitrate.

12. The gas generating composition of claim 1 wherein the guanylurea nitrate is synthesized by reacting dicyandiamide with nitric acid.

13. A gas generating device containing the gas generating composition of claim 1 in ignition communication with an ignitor for initiating combustion of the gas generating composition.

14. An automotive inflatable restraint system comprising:

the gas generating device of claim 13 connected with a collapsed inflatable airbag cushion to effect inflation thereof.

15. A gas generating composition comprising:

a fuel component in a relative amount of between about 20 to about 70 composition weight percent, wherein between about 10 to 100 percent of the fuel component is guanylurea nitrate and an oxidizer component in a relative amount of between about 30 to about 80 composition weight percent, wherein the oxidizer component includes at least one transition metal-containing basic metal nitrate oxidizer present in sufficient relative amount such that, upon combustion reaction initiation of the at least one transition metal-containing basic metal nitrate oxidizer with the guanylurea nitrate, reaction products including a quantity of nitrogen gas are produced, and wherein said gas generating composition has a flame temperature of less than 2200 K.

16. The gas generating composition of claim 15 wherein said gas generating composition is free of nitroaminoguanidine.

17. The gas generating composition of claim 15 wherein the at least one basic metal nitrate is basic copper nitrate.

18. The generating composition of claim 15 additionally comprising at least one additional non-azide fuel material.

19. The gas generating composition of claim 15 wherein the guanylurea nitrate is synthesized by reacting dicyandiamide with nitric acid.

20. A gas generating composition comprising:

a fuel component in a relative amount of between about 20 to about 70 composition weight percent, wherein between about 10 to 100 percent of the fuel component is guanylurea nitrate and an oxidizer component in a relative amount of between about 30 to about 80 composition weight percent, wherein the oxidizer component includes at least one transition metal-containing metal ammine nitrate oxidizer present in sufficient relative amount such that, upon combustion reaction initiation of the at least one transition metal-containing metal ammine nitrate oxidizer with the guanylurea nitrate, reaction products including a quantity of nitrogen gas are produced, and wherein said gas generating composition has a flame temperature of less than 2200 K.

21. The gas generating composition of claim 20 wherein said gas generating composition is free of nitroaminoguanidine.

22. The gas generating composition of claim 20 wherein the at least one metal ammine nitrate is copper diammine dinitrate.

23. The gas generating composition of claim 20 additionally comprising a quantity of ammonium nitrate.

24. The gas generating composition of claim 23 comprising a total metal ammine nitrate content in an amount sufficient to phase-stabilize the quantity of ammonium nitrate.

25. The gas generating composition of claim 20 additionally comprising at least one additional non-azide fuel material.

26. The gas generating composition of claim 20 wherein the guanylurea is synthesized by reacting dicyandiamide with nitric acid.

* * * * *